US010603816B2

(12) United States Patent
Tuomola

(10) Patent No.: US 10,603,816 B2
(45) Date of Patent: Mar. 31, 2020

(54) ARRANGEMENT FOR CASTING CONCRETE PRODUCTS

(71) Applicant: Elematic Oyj, Akaa (FI)

(72) Inventor: Juha Tuomola, Ylöjärvi (FI)

(73) Assignee: Elematic Oyj, Akaa (FI)

( * ) Notice: Subject to any disclaimer, the term of this patent is extended or adjusted under 35 U.S.C. 154(b) by 0 days.

(21) Appl. No.: 16/246,732

(22) Filed: Jan. 14, 2019

(65) Prior Publication Data

US 2019/0143561 A1 May 16, 2019

Related U.S. Application Data

(63) Continuation of application No. 14/581,312, filed on Dec. 23, 2014, now abandoned.

(30) Foreign Application Priority Data

Dec. 31, 2013 (FI) ..... 20136338

(51) Int. Cl.
*B28B 15/00* (2006.01)
*B28B 5/04* (2006.01)
*B28B 7/00* (2006.01)

(52) U.S. Cl.
CPC ..... *B28B 15/00* (2013.01); *B28B 5/04* (2013.01); *B28B 7/0002* (2013.01)

(58) Field of Classification Search
CPC ..... B28B 15/00; B28B 7/0002; B28B 5/04
USPC ..... 425/219, 258, 259, 347, 353
See application file for complete search history.

(56) References Cited

U.S. PATENT DOCUMENTS

| | | | |
|---|---|---|---|
| 4,259,050 | A | 3/1981 | Borocman |
| 4,421,710 | A | 12/1983 | Borocman |
| 5,090,555 | A | 2/1992 | Kura |
| 6,530,769 | B1 | 3/2003 | Rondaeu et al. |
| 6,827,570 | B2 | 12/2004 | Sumrall et al. |
| 6,881,048 | B1 | 4/2005 | Tokita |
| 7,798,316 | B2 | 9/2010 | Powers et al. |
| 7,988,123 | B2 | 8/2011 | Davies et al. |

FOREIGN PATENT DOCUMENTS

| | | | |
|---|---|---|---|
| DE | 4111523 | A1 | 10/1992 |
| FR | 933276 | A | 4/1948 |
| FR | 2337681 | A1 | 8/1977 |

(Continued)

OTHER PUBLICATIONS

Finnish Patent and Registration Office, Search report of Finnish Application No. 20136338, dated Aug. 12, 2014, 1 page.

(Continued)

*Primary Examiner* — Joseph S Del Sole
*Assistant Examiner* — Thu Khanh T Nguyen
(74) *Attorney, Agent, or Firm* — Berggren LLP

(57) ABSTRACT

The invention relates to an arrangement for casting concrete products, which comprises at least one central transfer wagon movable on a path on a center process line for moving the molds/mold tables from one work station for a process stage to another work station on a main level of the production process line, which work stations are located along the path of the central transfer wagon on at least at one side of the path of the center process line. At least one of the central transfer wagons of the arrangement comprises a lifting mechanism by which the molds/mold tables are liftable to at least one upper level.

11 Claims, 2 Drawing Sheets

(56) References Cited

FOREIGN PATENT DOCUMENTS

Figure 1A:
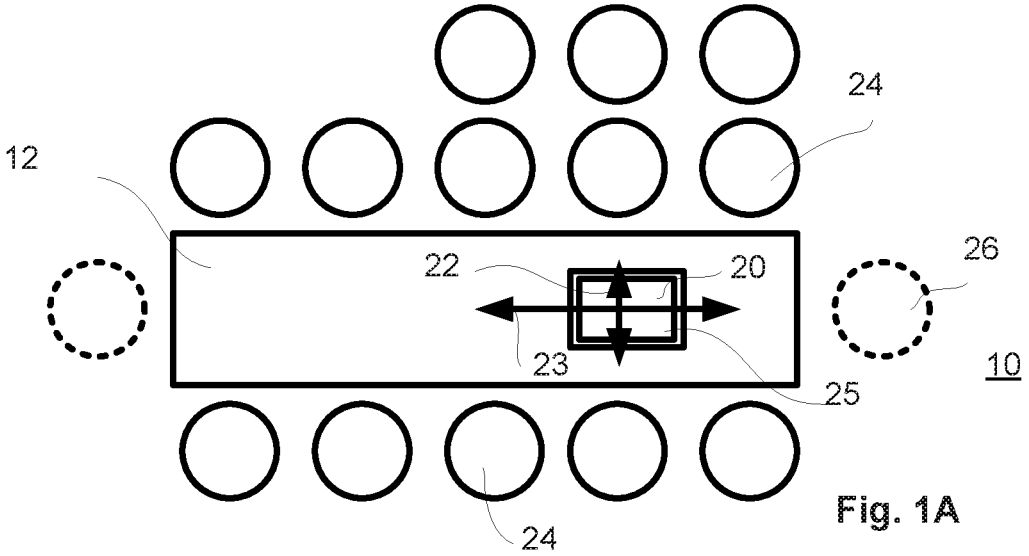

| | | | |
|---|---|---|---|
| JP | S5120533 | B1 | 6/1976 |
| WO | 0164409 | A1 | 9/2001 |
| WO | 2013161064 | A1 | 10/2013 |

OTHER PUBLICATIONS

European Patent Office, European Search Report of Application No. 14197113.5 dated Oct. 8, 2015, 7 pages.

ARRANGEMENT FOR CASTING CONCRETE PRODUCTS

PRIORITY

This application is continuation of U.S. application Ser. No. 14/581,312 filed on 23 Dec. 2014, which claims priority of Finnish application FI 20136338 filed on 31 Dec. 2013, the contents of which are incorporated herein by reference.

BACKGROUND

The present invention relates to casting of concrete products. More precisely the present invention relates to an arrangement for casting concrete products.

In casting production processes the casting is performed in different stages at work stations and different types of lines are used, for example circulating lines such as forced circulation lines and center conveyance lines.

In forced circulation lines mold tables and molds built on them are transferred by a roll trestle in a successive order from one work station, in which a casting production process stage is performed, to next work station, in which next process stage is performed, and thus the process stage taking the longest time defines the speed of the forced circulation line.

In circulating lines mold tables, on which casting molds are built, are mounted on tracks and circulate through the work stations for the stages of the production process.

The center conveyance line comprises a central transfer wagon for moving the mold tables with molds built on them from one work station for a process stage to another work station. The work stations for process stages can be located on either side of path of the carriage or at either end of the path. The path for the central transfer wagon is typically formed by rails or guides.

The casting lines thus comprise of a plurality work stations between which the casting mold table is transferred for the different stages of the production process. The stages of the production process can comprise for example cleaning of the mold table, furnishing the mold table with fixed and detachable mold sidewalls to form the casting mold and setting of other required equipment, such as reinforcements etc., on the mold, casting of the concrete mass to the mold, together with required vibrating actions during the casting, leveling the upper surface of the product to be cast, curing the fresh cast product, demolding, in which the cast product is removed from the mold generally together with tilting of the mold and the mold sidewalls are removed from the mold table. Depending on the type of the production process line the line may comprise one or more work stations for one type of process stage. The number of work stations for each type of process stage is limited by the floor space available on the main level of the production process.

The casting of concrete mass into the mold can also be carried out in different stages if for example different layers need to be added to the product to be cast such as insulation layers in cases of insulated wall elements.

In the furnishing stage the required reinforcements, such as one or more metal meshes and lattice structures are added and fixed in the mold after the mold is built with mold sidewall on the mold table. These required reinforcements are generally prefabricated in a separate reinforcement shop and taken to the reinforcement work station of the line.

SUMMARY OF THE INVENTION

An object of the present invention is to create an arrangement for casting concrete products providing new possibilities for layout structure and production control.

An object of the present invention is to create an arrangement in which the limitations due to the floor space of the main level for the number of work stations for each type process stage is at least minimized.

In order to achieve the above objects and those that will come apparent later the arrangement according to the invention is mainly characterized in the claims.

Dependent claims present advantageous features and embodiments of the invention.

According to the invention the arrangement for casting concrete products comprises at least one central transfer wagon movable on a path for moving the molds/mold tables from one work station for a process stage to another work station on a main level of the production process line, which work stations are located along the path of the central transfer wagon on at least at one side of the path, advantageously on both sides of the path. At least one of the central transfer wagons comprises a lifting mechanism by which the mold can be lifted to an upper level, for example to a work station located above the main level of the production process line on. The upper level is advantageously located one floor above the main level. The work station can be in addition to a station used for process stage be also a station for storage or exchange etc. By this the space above the main level is utilizable for the production process, for example for furnishing the mold or for demolding or for other wise handling the concrete product under a production process or related stage; for example lifting, coating, floating, insulating etc.

In casting concrete products the mold is typically built on the mold table by fastening the side walls to the mold table and the forming the actual mold by movable walls on the mold table. In this description and claims the terms mold/mold table are used in connection with different process stages and transfers between the stages even though in some stages actually only the mold table is transferred as the mold has yet not been formed or it has already been demolded or in some stages the mold table is transferred with the mold and with the casted concrete product. It should also be noted that longitudinal and cross transfers may relate to the direction of the sides of the mold table but they may also be perpendicular in relation to the sides of the mold table.

According to an advantageous feature of the invention the central transfer wagon comprises longitudinal transfer mechanism and/or cross transfer mechanism by which the mold table is moved onto and from the central transfer wagon. Advantageously the longitudinal transfer mechanism and/or cross transfer mechanism are located on the lifting mechanism thus providing transfers of the mold table onto and from the central transfer wagon in addition to the main level on the upper level.

According to an advantageous feature of the invention the arrangement further comprises at least two process levels: main process level and at least one upper level, which upper level comprises at least one opening for passing through the mold table by the lifting mechanism of the central transfer wagon and locking means by which the mold table is fastened on the upper level and thus releasing the central transfer wagon for other transportation needs of the production process line, for example transfers of other molds on the main level, and safety means by which the safety of personnel is ensured.

According to another advantageous feature the safety means comprise guard rails and safety limits by which safety of working personnel is ensured.

According to another advantageous feature the arrangement comprises an intermediate level between the main level and the upper level for work stations.

By the invention several advantages are achieved. The central transfer wagon with the lifting mechanism decreases investment as local lifting devices and transfer devices are not needed. Furthermore flexibility of production control is increased, since the central transfer wagon with the lifting mechanism provides transfers of molds with the possibility of optionally select work stations. For example when compared to traditional center conveyance line with a carriage according to prior art space usage is more effective as the space above the main level can be utilized for production process work stations and stages of the production process for example number of work stations can be increased from ten to twenty as the extra ten stations can be located on the above level and only same floor space area is required on the main level.

The arrangement for casting concrete products according to the invention is utilizable in various ways.

For example when producing twin-shell slabs the central transfer wagon with the lifting mechanism lifts the mold table to a separate turning/tilting device and thus separate lifting means such as a crane is not needed and instead of prior art type of tilting devices with lifting and turning functions only a simple tilting means with turning function are needed as the central transfer wagon with the lifting mechanism delivers the mold stations to the turning/tilting station and takes care of lifts at the stations and further the transfers from the station to further processing. Advantageously the turning/tilting station is located at one of the ends of the center process line i.e. the path of the central transfer wagon.

For example in an arrangement for casting concrete products comprising more than one central transfer wagons the central transfer wagon with the lifting mechanism can be used to free one work station along the center process line when the mold table needs to be moved from one carriage to another. In this case the carriage lifts the mold table to an exchange station where the mold table is locked at its place and the carriage moves to next need and another carriage picks up the mold table. The exchange station is located at upper level, which might be an intermediate upper level between main level and the upper level with work stations, thus also upper level work stations are available for process stages. The intermediate upper level stations can also be used as curing stations.

SHORT DESCRIPTION OF THE DRAWINGS

Figure 1B:
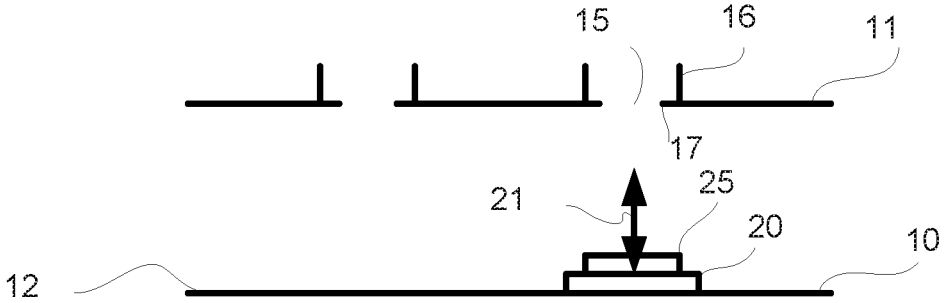
Figure 1C:
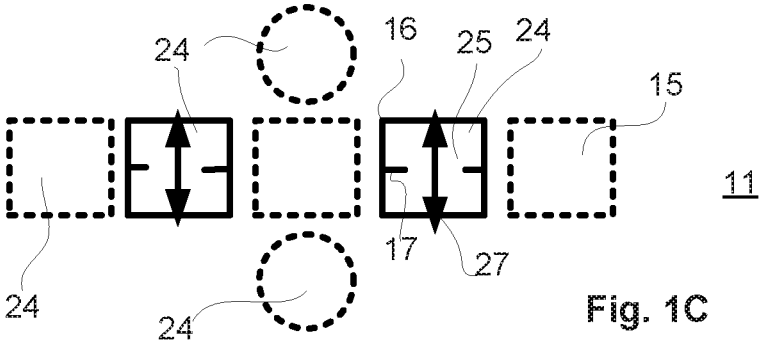
Figure 2:
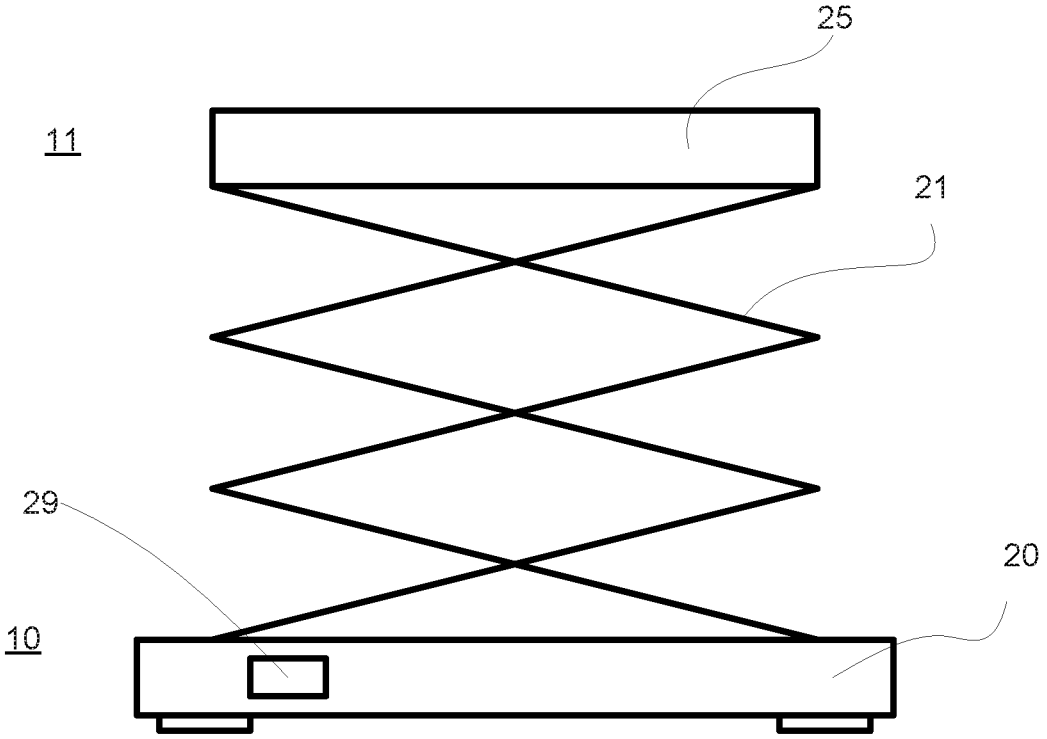

In the following the invention and its advantages are explained in greater detail below in the sense of examples and with reference to accompanying drawings, where in FIGS. 1A-1C is schematically shown an example of a casting production process line, in which the present invention is utilized and in FIG. 2 is schematically shown an example of a central transfer wagon with a lifting mechanism according to an example of the arrangement according to the present invention.

In the figures the corresponding elements, parts and part components of the arrangement are denoted by same reference signs in the figures unless otherwise mentioned.

DETAILED DESCRIPTION OF THE INVENTION

In the example of FIGS. 1A-1C the production process line is a center conveyance line with work stations 24 located on both longitudinal sides of the path of the central transfer wagon 20 in the center process line 12. In FIG. 1A is shown the part of the production process line located at the main level 10 seen from above and in FIG. 1B is shown the production process line seen from side and in FIG. 1C is shown the part of the production process line located at the upper level 20. In this example the production process line comprises two levels but it can also comprise more levels.

The central transfer wagon 20 is movable on longitudinal path on the center process line 12 located centrally between on both sides of the path located work stations 24. The work stations 24 are located on each side on a row with several work stations 24 next to each other. On either or on both sides of the center process line 12 there may be more than one row of work stations 24. At either or at both ends of the center process line 12 a turning station 26 may be located. The central transfer wagon 20 is depending on the process stage provided with the mold table/the mold 25. The central transfer wagon 20 comprises longitudinal transfer mechanism 23, cross transfer mechanism 22 and lifting mechanism 21. By the longitudinal transfer mechanism 23 the mold tables 25 are moved in and from the central transfer wagon 20 in longitudinal direction. By the cross transfer mechanism 22 the mold table (with or without the mold depending on the process stage) 25 is moved to a work station 24 or fetched from a work station 24 on either side of the center process line 12 as required by the process stage to be performed. By the lifting mechanism 21 the mold table 25 is lifted from the main process level 10 to an upper process level 11 or fetched from the upper process level 11 and returned to the main process level 10.

As can be seen from FIGS. 1B-1C the upper process level 11 comprises openings 15 through which the mold table 25 is moved to the upper level 11. The mold table 25 may be attached at the opening 15 by a locking mechanism 17 for the process stage to be performed at this upper level work station 24. Or it may be moved in cross direction by an upper level cross transfer mechanism 27 to a work station 24 on the upper level 11 located next to the opening 15. At the opening 15 is located safety means, for example guard rails 16 by which the safety of personnel is ensured.

In the example of FIG. 2 the central transfer wagon 20 comprises a lifting mechanism 21 with an actuator 29 for lifting the mold table 25 to an upper level 11 from the main level 10 and for lowering the mold table 25 from the upper level 11 to the main level 10 onto the central transfer wagon 20. In the central transfer wagon 20 the cross transfer mechanism 22 can be arranged on the top of the lifting mechanism 21 and thus no separate upper level lifting mechanism 27 is needed. The longitudinal transfer mechanism 23 can also be provided on the lifting mechanism 21.

As shown in the example of the figures the arrangement for casting concrete products comprises a central transfer wagon 20 movable on a path of the center process line 12 for moving the molds/mold tables 25 from one work station 24 for a process stage to another work station 24 on a main level of the production process line, which work stations 24 are located along the path of the central transfer wagon 20 on at least at one side of the center process line 12, advantageously on both sides. The central transfer wagon 20 comprises the lifting mechanism 21 with on actuator 29 by which the mold table 25 can be lifted to a work station 24 located in the upper level 11 above the main level 10 of the production process line, advantageously located one floor above the main level 10.

The arrangement thus comprises at least two process levels: main process level 10 and at least one upper level 11, which upper level 11 comprises at least one opening 15 for passing through the mold table 25 by the lifting mechanism 21 of the central transfer wagon 20 and locking means 17 by which the mold table 25 is fastened on the upper level 11 and thus releasing the central transfer wagon 20 for other transportation needs of the production process line, for example transfers of other mold tables 25 on the main level 10, and safety means 16 by which the safety of personnel is ensured.

REFERENCE SIGNS USED IN THE DRAWING

10 main level
11 upper level
12 center process line
15 opening
16 guard rails
17 locking mechanism
20 central transfer wagon
21 lifting mechanism
22 cross transfer mechanism
23 longitudinal transfer mechanism
24 work station
25 mold/mold table
26 tilting table
27 upper level cross transfer mechanism
29 actuator

What is claimed is:

1. An arrangement for casting concrete products, which comprises:

a main process level located on a first floor and comprising a first plurality of work stations;

at least one upper process level located on a second floor above the first floor and comprising a second plurality of work stations for overcoming limitations of a floor space of the main process level; and at least one central transfer wagon movable on a path on a center process line of the main process level for moving molds or mold tables or both from one work station for a process stage to another work station, where the one and the other work stations are corresponding work stations out of the first and second pluralities of the work stations located on one or both sides of the path on the first or the second floor for performing corresponding steps of a process for the casting concrete products, wherein the at least one of the central transfer wagons of the arrangement comprises a lifting mechanism by which the molds or the mold tables or both are liftable to the at least one upper process level on the second floor, and a cross transfer mechanism is configured to move the molds or the mold tables or both to or from any of work stations located on the one or both sides of the path on the first or the second floor, and wherein the at least one upper process level comprises at least one opening in the second floor for passing through the molds or the mold tables or both by the lifting mechanism of the central transfer wagon and a locking mechanism for fastening the molds or the mold tables or the both to the at least one upper process level on the second floor.

2. The arrangement according to claim 1, wherein a station out of the first and second pluralities of the work stations is configured to be used for a corresponding process stage, for a storage or for an exchange of mold tables between central transfer wagons.

3. The arrangement according to claim 1, wherein the central transfer wagon comprises a longitudinal transfer mechanism by which the mold tables and molds are moved in and from the central transfer wagon in a longitudinal direction along the pass.

4. The arrangement according to claim 3, wherein the longitudinal transfer mechanism, the cross transfer mechanism or both are located on the lifting mechanism providing transfers of the mold table onto and from the central transfer wagon on the at least one upper process level of the second floor as well as on the main process level of the first floor.

5. The arrangement according to claim 1, wherein the arrangement comprises an intermediate level between the main level and the at least one upper level for placing further work stations.

6. The arrangement according to claim 1, wherein the arrangement comprises at least one turning/tilting station located at least at one of the ends of the center process line.

7. The arrangement according to claim 1, further comprising safety means for providing personnel's safety.

8. The arrangement according to claim 1, wherein the second plurality of work stations doubles a total number of work stations on the first and second floors relative to a number of the first plurality of work stations.

9. The arrangement according to claim 1, wherein the at least one central transfer wagon is movable on rails or guides.

10. The arrangement according to claim 1, wherein the at least one central transfer wagon comprises the cross transfer mechanism.

11. The arrangement according to claim 1, further comprising an upper level cross transfer mechanism configured to move the molds or the mold tables or both to a corresponding work station on the second floor.

* * * * *